US005507124A

United States Patent [19]

Tadros et al.

[11] Patent Number: 5,507,124

[45] Date of Patent: Apr. 16, 1996

[54] CONCRETE FRAMING SYSTEM

[75] Inventors: Maher K. Tadros; Say-Gunn Low, both of Omaha; Jagdish C. Nijhawan, Bellevue, all of Nebr.

[73] Assignee: The Board of Regents of the University, Lincoln, Nebr.

[21] Appl. No.: 760,996

[22] Filed: Sep. 17, 1991

[51] Int. Cl.[6] ..... F04G 21/00

[52] U.S. Cl. ..... 52/251; 52/259; 52/741.14

[58] Field of Search ..... 52/250, 263, 283, 52/702, 236.9, 125.1, 745; 264/228

[56] References Cited

U.S. PATENT DOCUMENTS

| | | | |
|---|---|---|---|
| 915,421 | 3/1909 | Eisen | 52/702 |
| 980,480 | 1/1911 | Bishop | 52/260 |
| 1,031,047 | 7/1912 | Conzelman | 52/259 |
| 1,053,646 | 2/1913 | Roberts | 52/262 |
| 1,060,853 | 5/1913 | Peirce | 52/283 |
| 1,516,074 | 11/1924 | Borg | 52/252 |
| 1,683,600 | 9/1928 | Black | 52/220.2 |
| 2,053,873 | 9/1936 | Niederhofer | 52/602 |
| 2,075,633 | 3/1937 | Anderegg | 52/223.9 |
| 2,294,554 | 9/1942 | Henderson | 52/220.2 |
| 2,618,146 | 11/1952 | Ciarlini | 52/259 |
| 2,844,023 | 7/1958 | Maiwurm | 52/223.8 |
| 3,074,209 | 1/1963 | Henderson | 52/221 |
| 3,918,222 | 11/1975 | Bahramian | 52/263 |
| 3,981,109 | 9/1976 | Termohlen | 52/125.1 |
| 4,081,935 | 4/1978 | Wise | 52/236.9 |
| 4,363,200 | 12/1982 | Goldenberg | 52/251 |
| 4,901,491 | 2/1990 | Phillips | 52/602 |

FOREIGN PATENT DOCUMENTS

| | | | |
|---|---|---|---|
| 2836863 | 3/1979 | Germany | 52/125.1 |
| 547443 | 8/1956 | Italy | 52/602 |
| 238948 | 8/1925 | United Kingdom | 52/602 |

OTHER PUBLICATIONS

Engineering News Record, Oct. 18, 1962, p. 56.

*Primary Examiner*—Carl D. Friedman

*Attorney, Agent, or Firm*—Vincent L. Carney

[57] ABSTRACT

To erect concrete structures, precast concrete beams are formed, columns having void spaces therein are erected and angle irons are temporarily mounted to said columns at beam level wherein said beams may be temporarily supported. At least one beam is positioned orthogonal to a column near the void in the column supported by the angle iron and cast-in-place concrete fills the void between the ends of said beams and said columns. In another embodiment, the columns are solid and the beams have openings of such a size as to fit around the columns so that they can be lowered to the proper beam height about the column and fastened, with the other ends of the beam being joined to adjacent beams.

9 Claims, 11 Drawing Sheets

CONCRETE FRAMING SYSTEM

BACKGROUND OF THE INVENTION

This invention relates to buildings formed at least partly of concrete, techniques for erecting such buildings and components thereof.

In one class of building in which concrete is used, at least partly precast concrete columns are erected and at least partly precast concrete beams are mounted to the columns. Joists or panels are then mounted side by side to the beams to form a continuous floor.

In one prior art type of concrete building of this class, columns are erected with spaces void of concrete in the columns at the level of beams such as at each floor in a multistory building. The beams are mounted adjacent to the void spaces, Reinforcing rods extend through the void spaces and cast-in-place concrete later fills the void spaces to form a joint, but initially there is no concrete therein. The beams are partly precast concrete and partly cast-in-place concrete and the joists are hollow concrete panels.

In this type of prior art building, the beams are initially supported by temporary shoring adjacent to the columns and the joists are positioned to connect the beams one to the other. The beams are hollow and of uniform cross section throughout their entire length. Cast-in-place concrete is utilized to connect the beams, joists and columns to form an integrally connected structure.

This prior art type of building has several disadvantages, such as: (1) it requires temporary shoring during its erection which is an added expense; (2) it requires a relatively large depth in the precast beams, thus increasing the height and cost of a building; (3) it requires a relatively large amount of cast-in-place concrete; and (4) it requires a relatively long time period of heavy equipment use for lifting beams and the like in place.

Under some circumstances, it is desirable to construct a building of entirely precast concrete. This can reduce the cost by reducing the amount of time that cranes are necessary and thus substantially reduce the cost of multistory buildings.

SUMMARY OF THE INVENTION

Accordingly, it is an object of the invention to provide a novel building, at least part of which is formed of precast concrete.

It is a further object of the invention to provide a novel technique for erecting concrete buildings.

It is a still further object of the invention to provide novel precast concrete components for buildings.

It is a still further object of the invention to provide a novel precast concrete beam that requires less depth and reduces the amount of concrete necessary.

It is a still further object of the invention to provide a novel technique for forming precast beams.

It is a still further object of the invention to provide a novel technique for erecting buildings that are of partly precast concrete in which the beams for each floor require less depth than conventional, thus being economical.

It is a still further object of the invention to provide a novel technique for erecting buildings that are partly made of precast concrete in such a way as to reduce the length of time that heavy cranes are necessary for the erection of the building.

In accordance with the above and further objects of the invention, precast concrete beams are mounted directly to the columns where they are supported during construction. In one embodiment, the columns have open portions at beam level and the beams are mounted near the openings by temporary supports, such as angle irons, mounted directly to the column. After the beams are mounted in place, a wire cage is positioned through the openings in the columns at an angle to the beams and forms are positioned supported by the temporary supports on the columns for filling the openings in the column and beam with cast-in-place concrete. In another embodiment, the beams and columns are entirely precast and the beams are mounted to permanent supports on the column.

In the one embodiment, after the forms are in place, reinforcement is positioned in the open ends of the beams as needed to meet the design strength and the joints between the beams and the columns are completed with cast-in-place concrete. After the concrete has hardened sufficiently, the forms and the temporary supports are removed from the column in the one embodiment.

To reduce the amount of concrete in the beams, the thickness of the concrete may be varied along the length of the beams in accordance with the expected load. The concrete is generally thickest at the columns and thinnest at the center of a span between columns.

The variations in thickness of the concrete in a beam may be achieved by having a slanted interior surface or by having openings in the beam formed during casting such as by hollow or lightweight forms or the like positioned in the beams prior to casting. The joists or hollow concrete panels are supported on outwardly extending flanges at the bottoms of the beams. Reinforcing is used both in the top and the bottom of the beams, with the reinforcing material such as steel rods being decoupled in sections not subject to internal tension.

The columns may be precast in sections or as one unit except for the voids at beam level in the one embodiment and, if precast in sections, may be joined one after the other with reinforcing rods extending beyond the top of a lower column passing into voids in the bottom of a higher column just above beam level at the elevation of a floor. Open portions in the bottom of a column permit the attachment of the reinforcing rods from the column below to a column above. The open spaces are filled by cast-in-place concrete or grouting later.

In the embodiment using entirely precast beams and columns, the columns and one end of the beams are precast with openings sized to receive a horizontal support plate and the beams are cast with a vertical opening the size of a column intersecting the support plate opening. The other end of the beam is formed with apertured support plates in it to permit attachment of one beam to another by fasteners such as anchor bolts.

During erection of the building, the columns are erected and the beams lifted above them and lowered to the appropriate floor. The openings in the beam and column are aligned and the support plate inserted through the beams and column to hold the one end. The opening of one end of a beam is aligned with the opening in another beam and the support plates cast in the beams are bolted together so that each beam is fastened near one end at the end of a span to a column and at both ends by fasteners such as anchor bolts to another beam.

From the above description, it can be understood that the components of the building, the building and techniques used in erecting the building and fabricating the components have several advantages, such as: (1) the building utilizes shallow beams, thus permitting a more economical building; (2) the technique of erecting one embodiment of the building requires less time for use of heavy cranes for lifting the component parts in place; (3) the component parts may be easily tailored to reduce bearing load and the amount of concrete in them; (4) the amount of cast-in-place concrete may be reduced or entirely eliminated in some embodiments; and (5) temporary shoring is unnecessary to erect the beams.

SUMMARY OF THE DRAWINGS

The above noted and other features of the invention will be better understood from the following detailed description when considered with reference to the accompanying drawings, in which.

DETAILED DESCRIPTION

Figure 1:
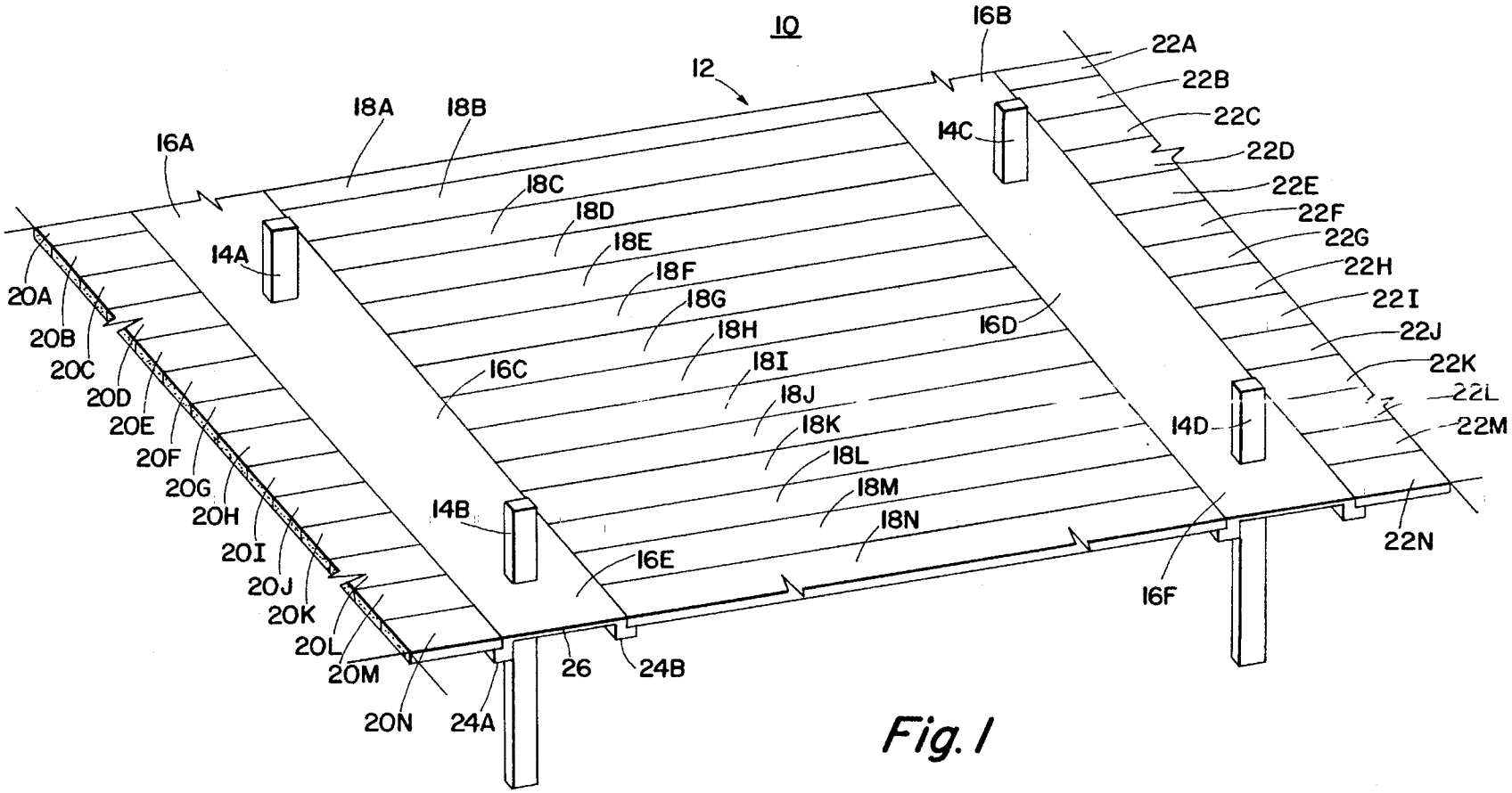
FIG. 1 is a fragmentary, perspective view of a portion of a building constructed at least partly of precast concrete in accordance with an embodiment of the invention.

In FIG. 1, there is shown a portion of a building 10 having a floor 12 and four columns 14A–14D defining a bay of a building. The floor is supported by beams 16A–16F and joists 18A–18N, 20A–20N and 22A–22N. The beam 16A is joined to the beam at the column 14A which is joined to the beam 16E at the column 14B; and the beam 16B is joined to the beam 16D at the column 14C which is joined to the beam 16F at the column 14D. The joists rest upon outwardly extending longitudinal central portions of the beams and form a flat surface therewith and the beams are supported by the columns. While a single floor is shown in FIG. 1 and a single span covered by joists or panels are shown, the techniques and components of this invention have special application to multiple story buildings.

The beams have longitudinal central portions mounted to the columns, such as shown at 26, which extend on either side of the columns a substantial distance, and are terminated by downwardly-extending, inverted T members or connecting walls having outwardly-extending flanges to receive the joists, which rest upon the flanges or the horizontal portions of the T's. With this arrangement, the floor may be constructed with a reduced or shallow depth, such as 16 inches, rather than a more conventional two feet. Accordingly, multiple story buildings can include more stories for the same height because of the reduced depth necessary for the floors.

Figure 2:
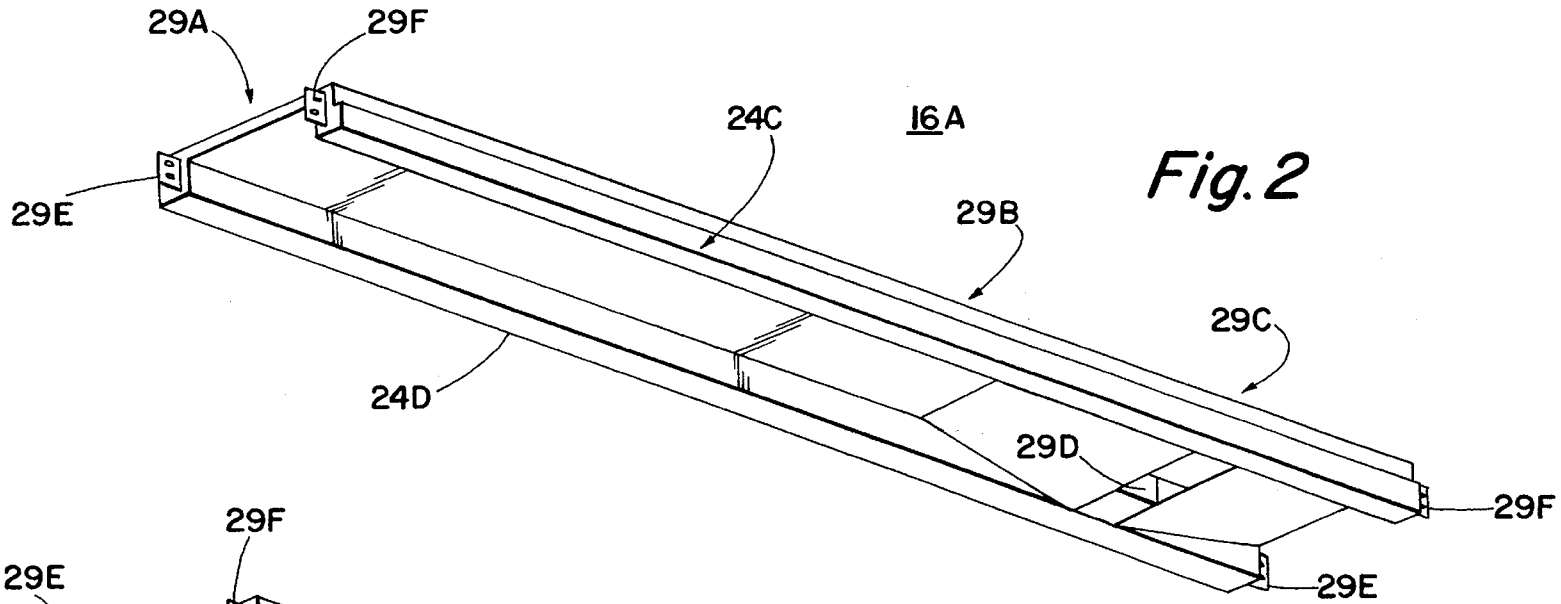
FIG. 2 is a perspective view of one embodiment of precast concrete beam usable in a portion of a multistory version of the building of FIG. 1.

In FIG. 2, there is shown a perspective view of one embodiment of beam 16A having a first end section 29A, a center section 29B and a second end section 29C, with the center section 29B being substantially fully precast and of substantially uniform thickness but thinner than the end section 29C. The end sections 29A and 29C include metal plates for attachment to another beam. The end portion 29C has a void space 29D shaped to receive a column passing through a thick concrete portion of the beam near an end so that the beam 16A can be moved to the top of a column of a multistory building and lowered to the proper floor and fastened. The plates 29E and 29F extending from the ends are for attachment to adjoining beams in a manner to be described hereinafter. For strength, transverse reinforcing rods (not shown in FIG. 2) and longitudinal reinforcing rods (not shown in FIG. 2) are included.

The amount of concrete in a beam is varied along its length in accordance with the necessary strength. Ledges 24C and 24D extend from the sides of the beam and are adapted to receive joists in the manner described in connection with the embodiment of FIG. 1.

Figure 3:
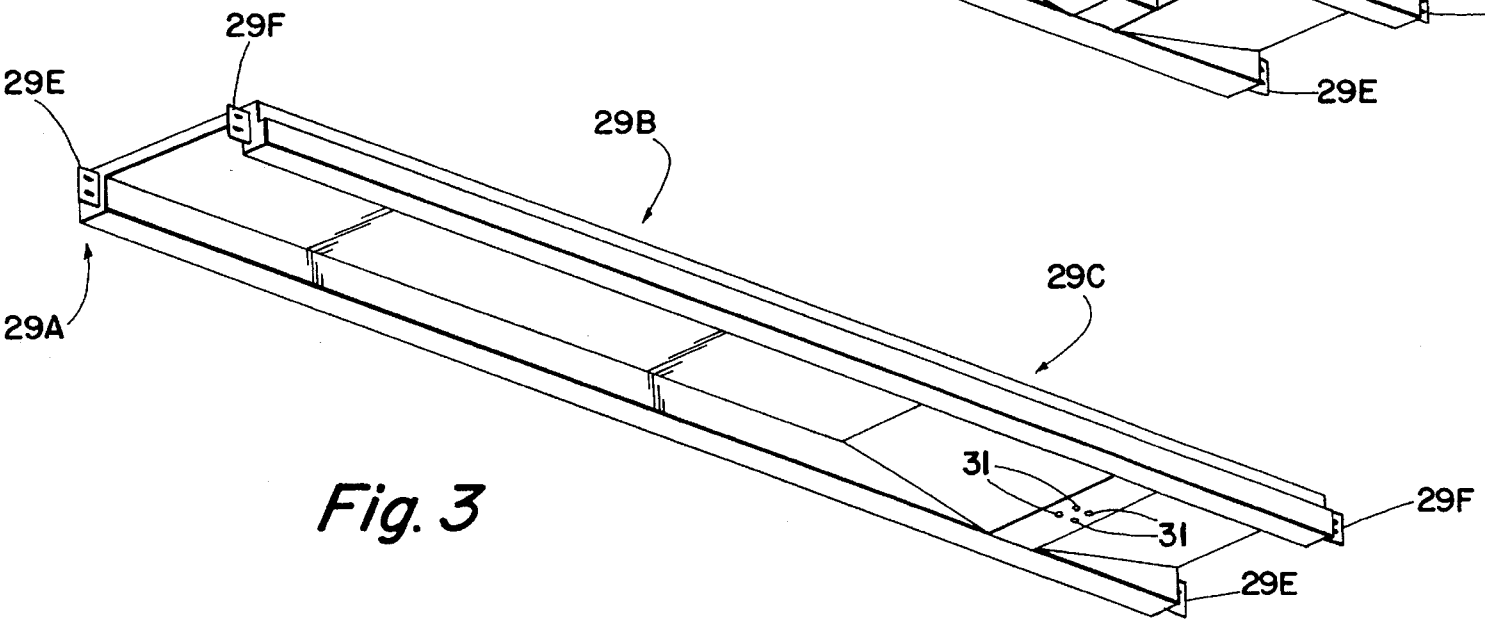
FIG. 3 is a perspective view of another embodiment of precast concrete beam usable in a portion of a single story version of the building of FIG. 1.

In FIG. 3, there is shown a perspective view of one embodiment of beam 16B having first, second and third end sections 29A, 29B and 29C similar to the beam of FIG. 2 and having the plates 29E and 29F similar to the beam of FIG. 2. However, because it is for a single story building made substantially completely of precast concrete instead of a multiple story building as in the case of FIG. 2, it includes four smaller vertical openings 31 sized to receive reinforcing rods in a manner to be described hereinafter instead of having a larger opening to receive a column passing through a thicker portion of the concrete.

Figure 4:
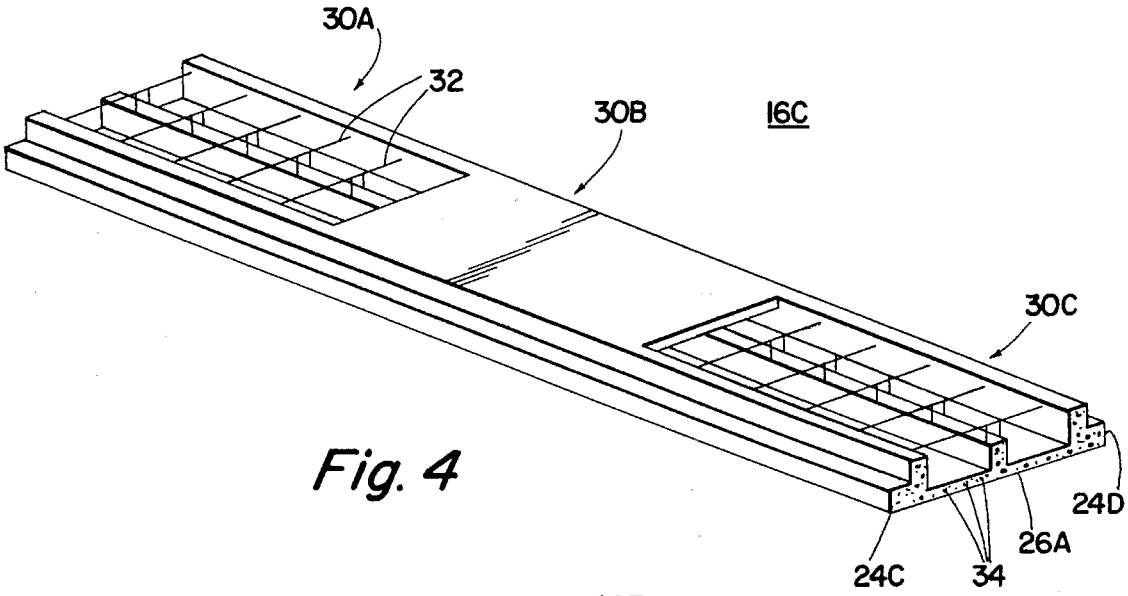
FIG. 4 is a perspective view of another embodiment of precast concrete beam usable in a portion of building of FIG. 1.

In FIG. 4, there is shown a perspective view of one embodiment of beam 16C having a first end section 30A, a center section 30B and a second end section 30C, with the center section 30B being substantially fully precast and the end sections 30A and 30C having void spaces to receive cast-in-place concrete for attachment to columns or other beams. For strength, transverse reinforcing rods, such as shown at 32, and longitudinal reinforcing rods, such as shown at 34, are included.

The amount of concrete in a beam is varied along its length in accordance with the necessary strength. Ledges 24C and 24D extend from the ends of the beam and are adapted to receive joists in the manner described in connection with the embodiment of FIG. 1.

Figure 5:
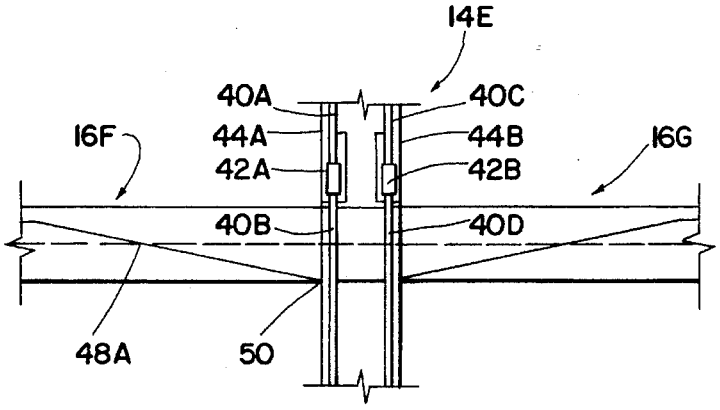
FIG. 5 is a fragmentary, elevational, sectional view of one embodiment of the beam of FIG. 2 taken near a column.

In FIG. 5, there is shown a sectional view of a column 14E and two beams 16F and 16G mounted to the column. As shown in this view, the beams 16F and 16G are thickest at the column 14E, as indicated at point 50, and slant upwardly at the bottom portions, as shown at 48A, to a center portion where they are thinner.

The column 14E includes reinforcing rods 40B and 40D which extend through the beam in tubes and upwardly above the beams 16F and 16G without the tubes to an upper section of column 14E where they are joined at 42A and 42B to reinforcing rods 40A and 40C in the upper section of column 14E. The joint may be made by a mechanical coupler, or bolted or spliced or welded or made by any suitable type of fastener. The sections at the joints 42A and 42B are filled in by cast-in-place concrete or grout after the joint is made as shown at 44A and 44B. This construction permits the column to be erected one floor at a time with the beams located on one floor before the next section of column is raised and connected in place for the next floor.

Figure 6:
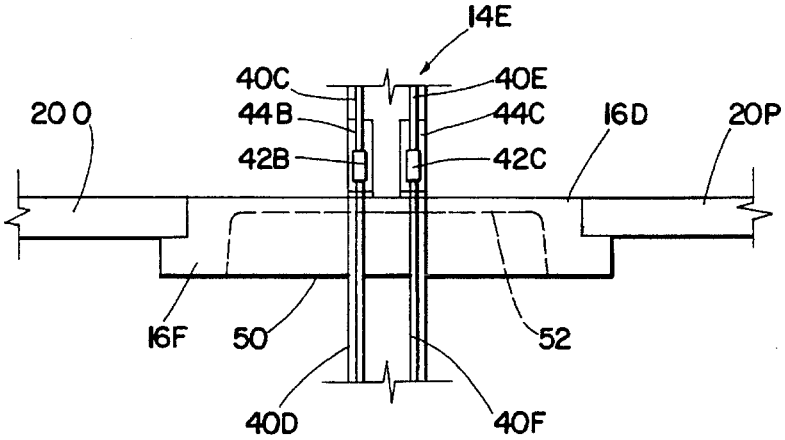
FIG. 6 is a fragmentary, elevational, sectional view of the beam of FIG. 2 taken near the center of the span.

In FIG. 6, there is shown a sectional view of the column 14E of FIGS. 2 and 5 at right angles to that shown in FIG. 5. As shown in this view, the thickness of the concrete is greatest at 50 at the beam and levels out at center section to 52 where it is thinnest. As in the case of FIG. 5, reinforcing rods are shown at 40C and 40E, there being four reinforcing rods in each upper section of column 14E. The ledge portions of the beams 16F and 16D support joists or panels 20O and 20P, respectively, at their outer extremities.

Figure 7:
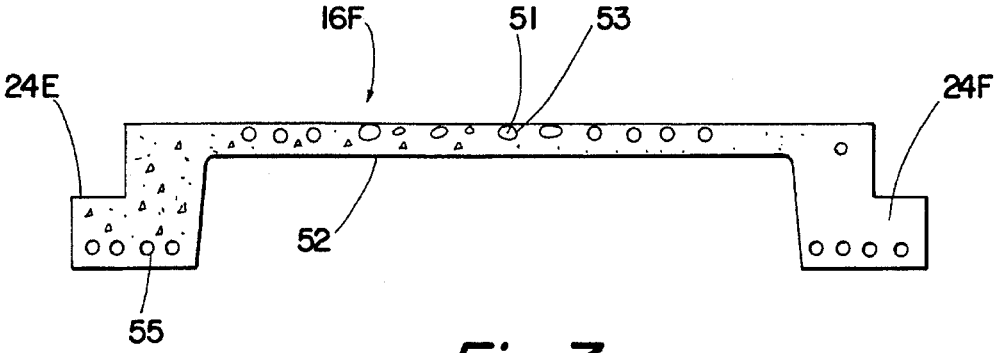
FIG. 7 is a fragmentary, cross-sectional view of one embodiment of beam taken at midspan between two columns in accordance with an embodiment of the invention.
Figure 8:
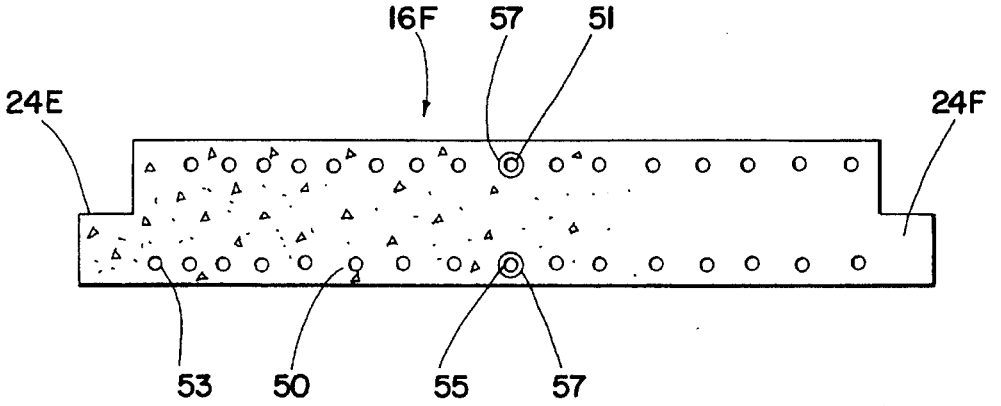
FIG. 8 is a fragmentary, elevational, cross-sectional view of the embodiment of FIG. 7 taken at an end where it is adjacent to a column in accordance with an embodiment of the invention.

In FIG. 7 and FIG. 8 there are shown two different cross sections of the beam, the cross section at midspan being shown in FIG. 7 with a reduced thickness at 52 in the longitudinal central portion, and the cross section at the column being shown in FIG. 8 with an increased thickness at 50. As shown in these views, the ledges 24E and 24F remain at the same level as the thickness of the beam increases to receive joists or panels.

At the midspan of each beam , the central section of reduced thickness has a length of 68 inches in one embodiment, the downwardly extending portions on each side have a length of 8 inches and the ledges 24E and 24F have lengths of 6 inches each.

Figure 9:
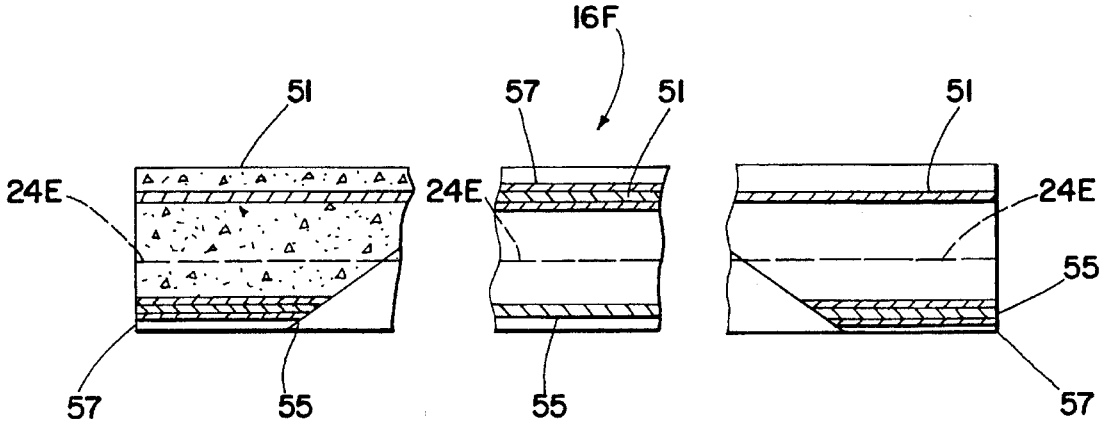
FIG. 9 is a longitudinal, sectional view of the embodiment of FIG. 7.

In FIG. 9, there is shown a broken-away, longitudinal, sectional view of the beam 16F showing the center portion and the end portions of the span covered by the beam taken through the sleeves 57 and reinforcement rods 51, 53 and 55. The length of the thickened center section 50 at the column is 84 inches. The total height in this embodiment is 16 inches and the height of the ledges is 8 inches.

As best shown in FIGS. 7 and 9, there are a plurality of prestressed reinforcing rods 51 extending near the top of the beam extending across the length of the beam in tension, at least some of which are decoupled from the concrete near the center at a location where the beam is not subject to tension forces near the top by sleeves 57 or the like. The decoupling is provided by any members that permit the concrete to slide with respect to the rod so that the stress in the rod applies stress to the concrete only where the internal forces in the concrete under load apply tension to the concrete and not where the concrete is in compression. The decoupling runs to a point in the beam that is not subject to internal tensile stress such as an flexural inflection point in the beam.

The lower rods 55 that are decoupled over a different portion of the span where the concrete is in tension at the bottom so that the stress from the top and bottom reinforcing rods do not resist each other and only provide tensile strength were needed to resist the load on the beam. In the preferred embodiment, there are 24 reinforcing rods along the top of the beams, 16 of which are decoupled near the center of the beam. There are also 24 prestressed reinforcing rods along the bottom of the beam 16F of which are decoupled over a portion of their length.

This arrangement is economical because the rods are prestressed in forms from one end of the form to the other as the precast concrete beams are cast. Consequently, they stretch across the entire beam or set of beams that are cast together in the same forms and it would not be good practice to include both top and bottom prestressed reinforcement rods except for the decoupling.

As best shown in FIGS. 8 and 9, there are a number of prestressed reinforcement rods 55 in compression along the bottom of the beam, some of which are decoupled near the ends of the span and near a column but which are not decoupled from the concrete near the center of the span so that they provide the opposite stress to the concrete at the cross section of a span where the rods near the top are alecoupled and are themselves decoupled where stress is provided by the top reinforcement rod. Thus, reinforcement rods are provided for both positive and negative moment in the beam without substantial interference between the two.

Figure 10:
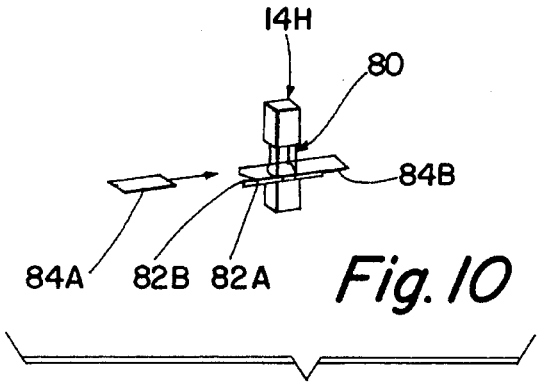
FIG. 10 is an exploded, simplified, perspective view of a step in the technique of assembling one embodiment of the building of FIG. 1.

In FIG. 10, there is shown an illustrative, perspective view of one stage used in the erection of the building of FIG. 1 using beams of the type shown in FIG. 4. As shown in this view, a column 14H includes a void 80 with reinforcing rods extending longitudinally to the column 14H through the void 80 near the corners of the column 14H. Steel angle irons 82A and 82B are mounted below the void 80 on opposite sides of the column to support formwork illustrated at 84A and 84B so that, when the beams are mounted in place, reinforced concrete can be utilized to fill the void 80. The angle irons 82A and 82B are attached to the column using threaded rods running through sleeves in the column to serve as temporary supports.

Figure 11:
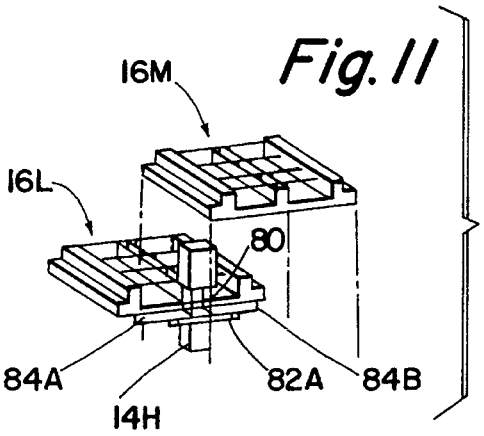
FIG. 11 is an exploded, simplified, perspective view of another step in the technique of assembling the building of FIG. 10.

In FIG. 11, there is shown an exploded, perspective, illustrative view showing another stage in the erection of the building in FIG. 10 in which two beams 16L and 16M are placed on the angle irons, one of which is shown at 82A about the column 14H for temporarily securing them.

Figure 12:
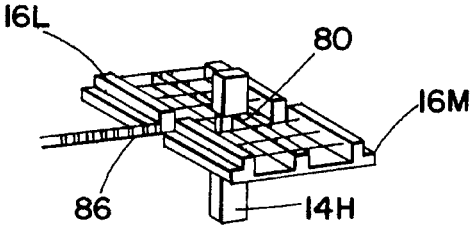
FIG. 12 is a simplified, perspective view of another step in the assembly of the building of FIG. 10.
Figure 18:
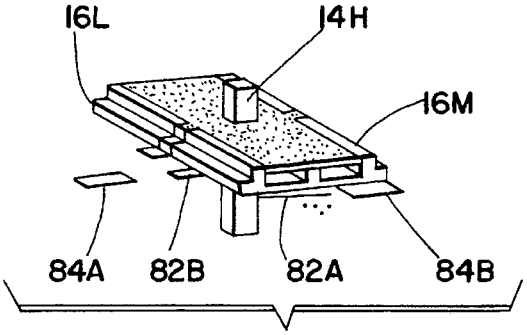
FIG. 18 is a simplified, exploded, perspective view illustrating another step usable in the erection of the building of FIG. 10.

In FIG. 12, there is shown another stage in which the beams mounted about the column 14H and a steel reinforcing cage 86 are inserted through the void 80 perpendicular to the column 14H so that it lies between the two beams 16L and 16M.

Figure 13:
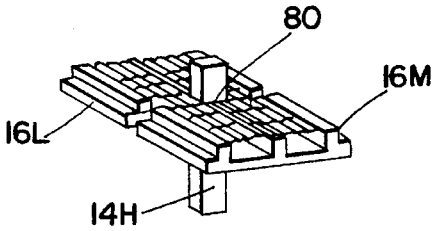
FIG. 13 is a fragmentary, perspective view of still another step in the assembling of the building of FIG. 10.

In FIG. 13, there is shown still another stage in which further reinforcing steel rods are placed in the end of the beams 16L and 16M extending between the two. The beams are of the type shown in FIG. 4 with a precast center portion but with open portions at the ends to receive reinforcement and cast-in-place concrete. They are not prestressed and are located for negative moment reinforcement at the beam 14H to compensate for downward loads at the middle span (not shown in FIG. 13).

Figure 14:
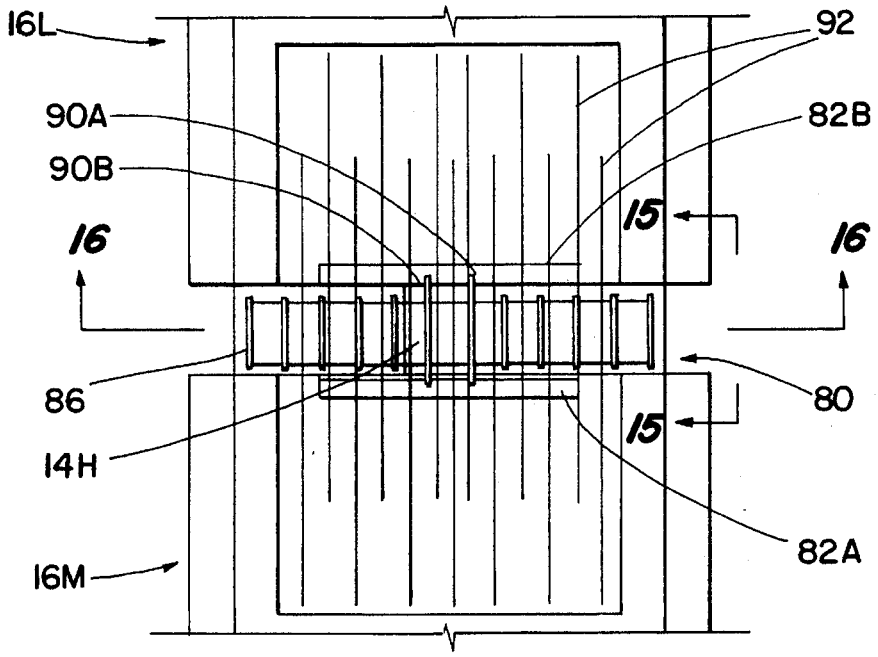
FIG. 14 is a simplified, plan, sectional view further illustrating the step of FIG. 13.

In FIG. 14, there is shown a plan, sectional view of the column 14H taken at the top of the void space 80 and showing a portion of the beams 16L and 16M to illustrate the end of the cast-in-place flanges therein. As shown in this view, the flange rests on forms supported by the angle irons 82A and 82B which are held by pins 90A and 90B to the concrete column 14H. As shown in this view, cage 86 provides reinforcement in the cast-in-place concrete joint, and for that purpose, has a length almost or substantially equal to the width of each of the beams 16L or 16M, is centered in the column, and parallel to the edge of the beams 16L and 16M.

Figure 16:
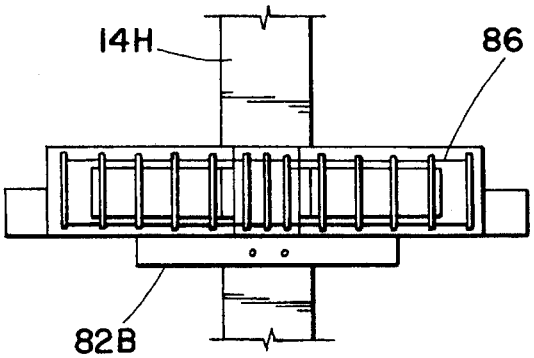
FIG. 16 is a fragmentary, simplified, sectional view taken through lines 16—16 of FIG. 14.
Figure 15:
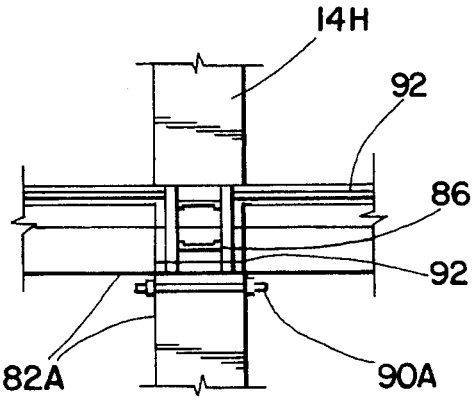
FIG. 15 is a fragmentary, simplified, sectional view taken through lines 15—15 of FIG. 14.

In FIG. 15 there is shown a sectional view of the column 14H taken through lines 15—15 of FIG. 14 and in FIG. 16 there is shown a fragmentary, sectional view of the column 14H taken through lines 16—16 of FIG. 14 showing the reinforcing rods 92, cage 86 and angle irons and the manner in which they cooperate to enable the joint to be formed with sufficient strength to support the beams after the angle irons are removed. These members form reinforcement within the cast-in-place concrete to form such a joint.

Figure 17:
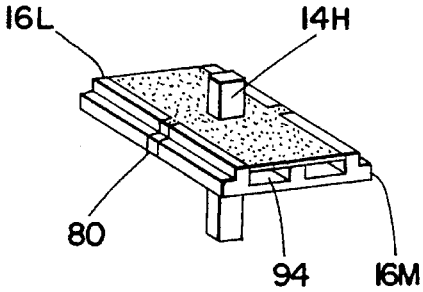
FIG. 17 is a fragmentary, perspective view illustrating still another step in the assembly of the building of FIG. 10.

In FIG. 17, there is shown still another stage in the erection of the building of FIG. 10 in which the void space 80 and the space between the beams 16L and 16M have been filled with concrete to form a joint of adequate strength. Forms are mounted to the angle irons to contain the concrete and cast-in-place concrete poured into the forms and within the voids such as shown at 94 in the beams. As soon as the concrete has achieved adequate strength, the forms, such as 84A, and the angle irons are removed as best shown in FIG. 16.

Figure 19:
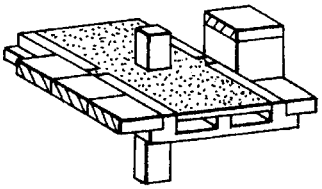
FIG. 19 is a fragmentary, simplified, perspective view illustrating a step usable in assembling the building of FIG. 10.

Finally, as shown in FIG. 19, the joists or panels are positioned with their ends resting on the ledges of the precast beams that support them. Preferably, they are hollow core panels for reasons of lightness. This may be done at the same time that the forms and angle irons are removed or may be done separately. An entire floor at beam level may be done at the same time.

Figure 20:
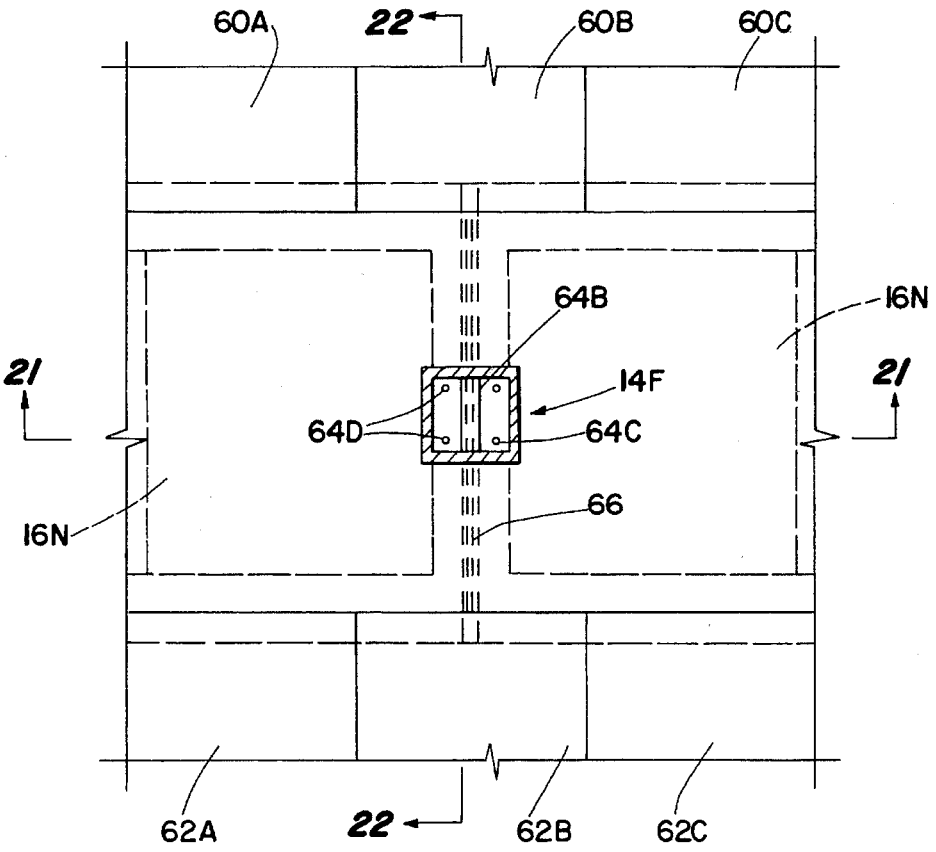
FIG. 20 is a fragmentary, plan, sectional view of a column and beam of another embodiment of the invention using entirely precast beams and columns.

In FIG. 20, there is shown another embodiment of column 14F and beam 16N which may be used to construct a building entirely of precast beams and columns so as to avoid excessive time of use of a crane. In this embodiment, the columns such as 14F, are cast as a unit with a horizontal aperture sized to receive a horizontal steel plate 66. The beams are also entirely precast with a corresponding horizontal aperture alignable with the horizontal aperture in the column to receive the horizontal plate 66 and also with an intersecting vertical aperture 17 sized to fit around the comumn 14F so that the beam can be raised to the top of the column and lowered around the column until its horizontal aperture is aligned with the corresponding horizontal aperture in the column to receive the steel plate 66 for support at the beam level for its floor.

In this manner the beams may be raised to the top of a column of a multistory building and lowered in succession to their floors one after the other from the bottom floor to the top floor and supported by corresponding steel plates 66. The steel plates are permanently installed.

The embodiment consists of precast hollow core or double tee joists, 8 feet wide, 16 inch thick beams, and multi or single story columns. Each beam is supported on one column and connected to other beams at both ends. The beams are spliced together at a location five feet away from the face of the column, which is also the flexural inflection point (location where moment is equal to zero). The beams are bolted together with steel plates, which are embedded in the beam, and anchor bolts. The plates are covered with cast-in-place concrete after the erection is completed.

Two types of construction are available in the new system: single story and multistory column construction. In single story column construction, column reinforcement is extended from the column in the lower level and spliced to reinforcing rods in the column above the beam level or connected with couplers or welded or fastened by any other means. The pockets are grouted for corrosion and fire protection after the splicing. To allow room for column reinforcing rods to run through, sleeves are pre-made in the beam at column area.

In multistory column construction, on the other hand, over-sized openings are made in the beam to allow columns to run through continuously. Gaps between beam and column are filled with energy absorbant materials. A steel bar is inserted transversely through the beam and column to transfer gravity loads into the column. As shown in this figure, thickness of the beam top flange varies along the span. From the splicing joint to a distance five feet away from the column face, the top flange has a constant thickness of 3.5 inches. It increases gradually from 3.5 inches to a full depth of 16 inches from a distance five feet away to the face of the column. Away from the column face, its thickness decreases from full depth to 3.5 inches, again, at a distance five feet away from the column face.

Figure 21:
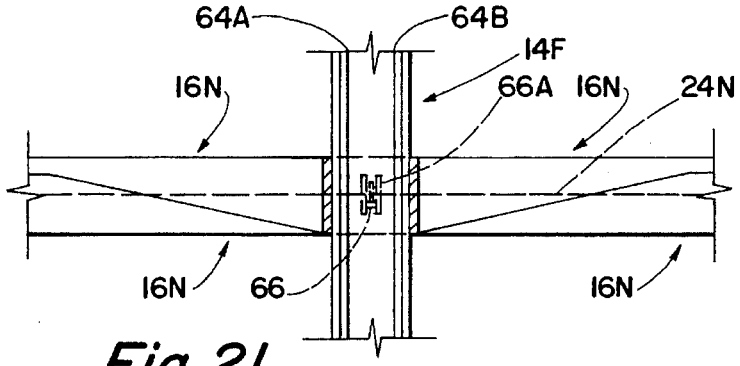
FIG. 21 is a fragmentary, sectional view through lines 21—21 of FIG. 20.

In FIG. 21, there is shown a fragmentary, sectional view of the column 14F and the beam 16N taken through lines 21—21 of FIG. 20 showing the steel plate 66 in the aperture 66A supporting the beam on the column. Similarly in FIG. 22, there is shown a fragmentary sectional view of the column 14F and beam 16N taken through lines 22—22 for FIG. 20, showing the steel beam extending through the beam and column to support the beam with the beam receiving joists 20D–20P on opposite sides.

Figure 23:
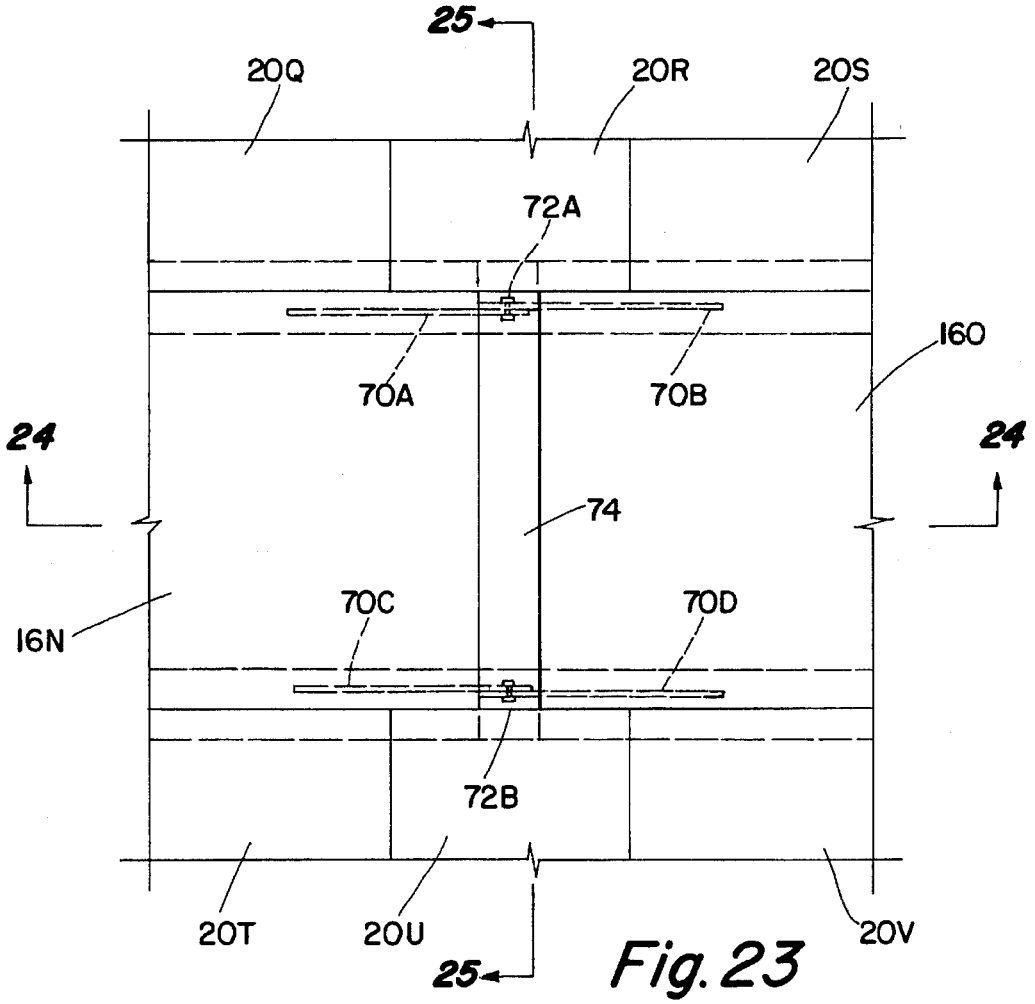
FIG. 23 is a fragmentary, plan, sectional view taken through a portion of a beam connected to another portion of a beam approximately 6 feet from a supporting column.

In FIG. 23, there is shown a plan, sectional view of a joint between two beams 16N and 16O supporting on one side of them, the joists or panels 20Q–20S, and on the other side, the joists or panels 20T–20V. Within the beam 16N on opposite sides are the reinforcing plates 70A and 70C and in beam 16O are the reinforcing plates on opposite sides 70B and 70D, with the reinforcing plates 70A and 70B being joined together by rivets or bolts or the like at 72A and the reinforcing rods 70C and 70D being joined together by reinforcing plates 72B. A center section 74 encompassing the joints is filled with cast-in-place concrete to hold the two beams together.

Figure 24:
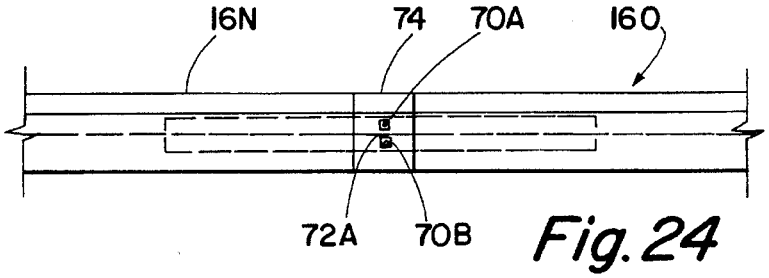
FIG. 24 is a fragmentary, sectional view through lines 24—24 of FIG. 23.

In FIG. 24, there is shown a sectional view through lines 24—24 of FIG. 23 showing the joint between the beams 16N and 16O and the joints 72A with the plates 70A and 70B, one under the other joined together within the cast-in-place concrete holding the beams rigidly together.

Figure 25:
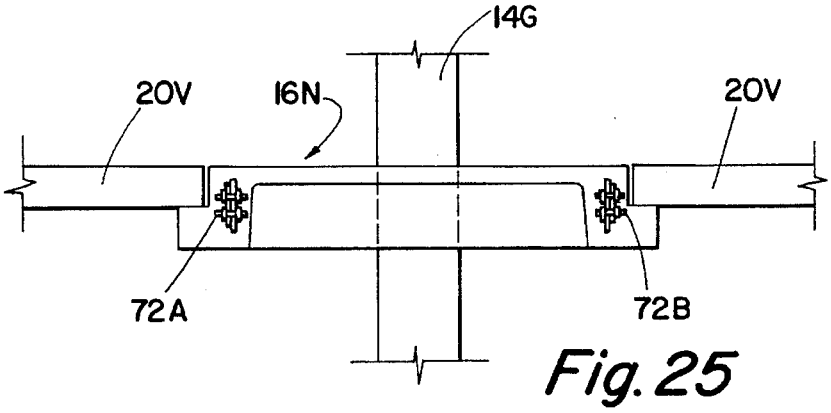
FIG. 25 is a fragmentary, sectional view taken through lines 25—25 of FIG. 23.

In FIG. 25, there is shown a fragmentary, sectional view taken through lines 25—25 of FIG. 23 showing the manner in which the joints 72A and 72B are fastened between the beams 16N and 16O to each other so that the respective reinforcing plates 70A, 70C, 70B and 70D aid in forming a sturdy connection.

Figure 22:
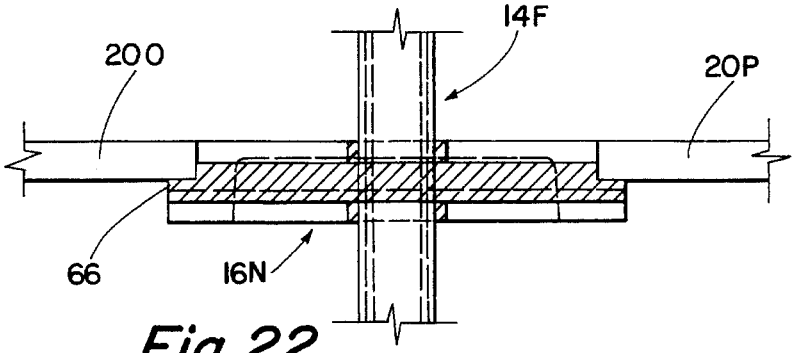
FIG. 22 is a fragmentary sectional view through lines 22—22 of FIG. 20.

The plates are precast into the beams and matched at the factory for ease in alignment. The beams are first lowered about a column as shown in FIGS. 20–22, and fastened to the column at one end. The other end reaches near the next column where it is fastened to the beam that fits around that column to form a continuous span. Thus, the beams are lowered in place, fastened with a plate 66 to a column at one end and to the next beam at the other end with bolts passing through the plates 70A–70D. In the alternative, the horizontal hole in the beam is not necessary and the beam may rest upon a support member passing through a horizontal hole in the column. In this manner the beams may be located and the heavy duty crane for lifting them removed before any cast-in-place concrete or other filler material used to reduce the time the heavy duty crane is needed.

Figure 26:
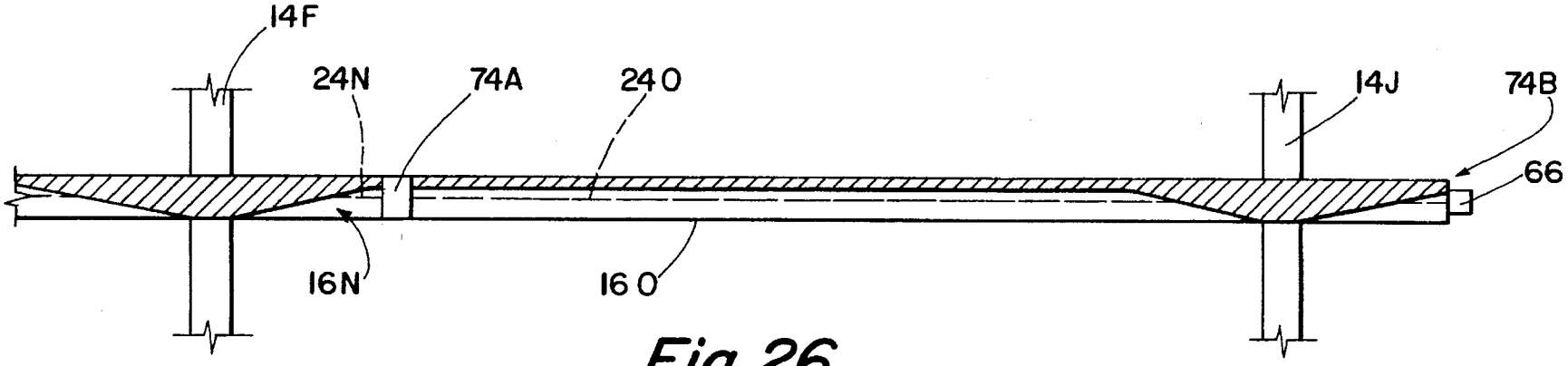
FIG. 26 is a longitudinal sectional view of the embodiment of beam and column of FIGS. 20–25.

In FIG. 26, there is shown a longitudinal, cross-sectional view of the columns 14F and 14J connected by a span that includes beams 16N and 16O connected by the joint 74A, illustrating the manner in which two beams are connected together in an embodiment in which the columns and beams are entirely precast for speed in assembly during the time that a heavy crane is needed. This view also illustrates the manner in which the reduced cross-sectional beams with improved reinforcement use less concrete while maintaining the ledges 64N and 64O level to receive joists (not shown in FIG. 26). In one embodiment of column, the column is recessed around its circumference at beam height to be joined by concrete to the beam for further support.

In FIGS. 27–31, there are shown cross-sectional views of different beams illustrating different techniques for reducing the thickness of the concrete at a particular cross section of the beam to match the load that is to be imposed on the beam. In each of these techniques, there are openings in the concrete supported by other elements or supported by lighter material. In each of these cases, while only one shape or configuration is shown at one cross section, the size of the openings or the lighter material may be reduced or increased at different locations along the same beam to accommodate different stress on the beam such as by having no openings near the columns and having larger openings and less concrete at midspan.

Figure 27:
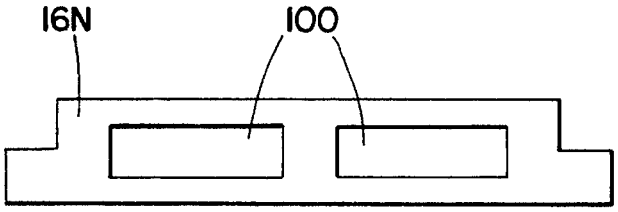
FIG. 27 is a sectional view illustrating an alternative embodiment of the beam of FIG. 2.
Figure 28:
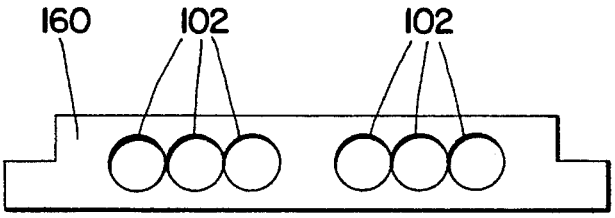
FIG. 28 is another sectional view illustrating still another embodiment of the beam of FIG. 2.
Figure 29:
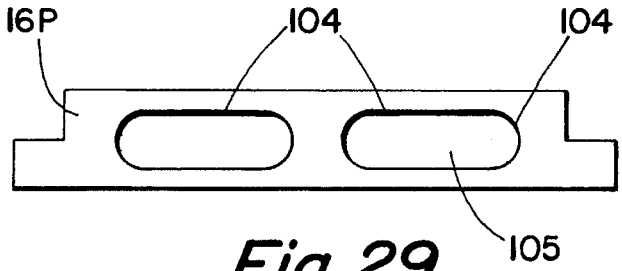
FIG. 29 is a sectional view illustrating still another embodiment of the beam of FIG. 2.
Figure 30:
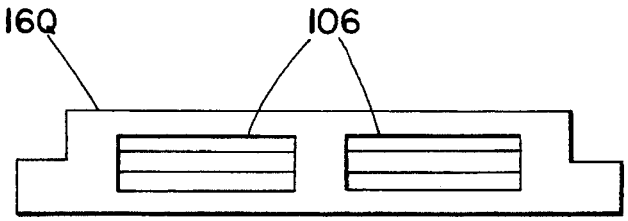
FIG. 30 is a sectional view illustrating still another embodiment of FIG. 2.

In FIG. 25, cardboard boxes 100 are used within the concrete to provide openings. In FIG. 26, inflated tubes 102 are inserted and the concrete cast about them. In FIG. 27, other shapes of light hollow containers 104 are filled with granular filling 105 that can be removed. The hollow bodies 104 are cast in the center portion of the beam and an outlet is provided for removing the ganular filling material. In FIG. 30, insulation board 106 is the filler material. In FIG. 21, tapered wedges 108 are utilized which are made of reasonably flexible material and have lugs 110 connected to them. This is so that the wedges may be collapsed together to pull out the tapered wedges 108. The wedges 108 may be retractable steel which can collapse inwardly to a smaller size. The opening for removing the wedges is then sealed with concrete.

Figure 31:
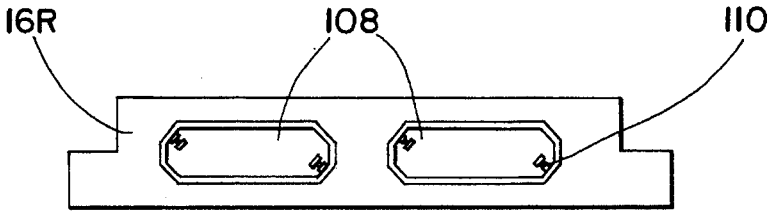
FIG. 31 is a sectional view illustrating still another embodiment of the beam of FIG. 2.
Figure 32:
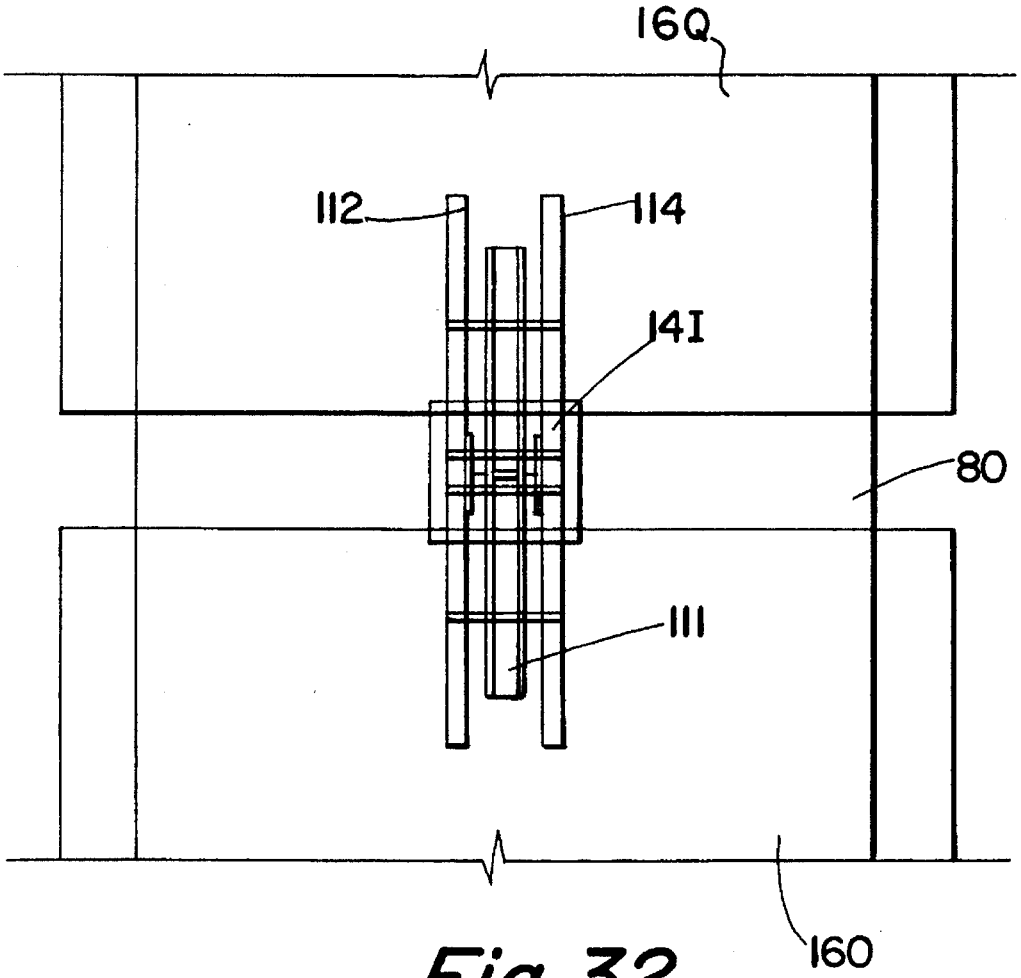
FIG. 32 is a fragmentary, plan, sectional view of a column and beam showing spaces for electrical feedthrough.
Figure 33:
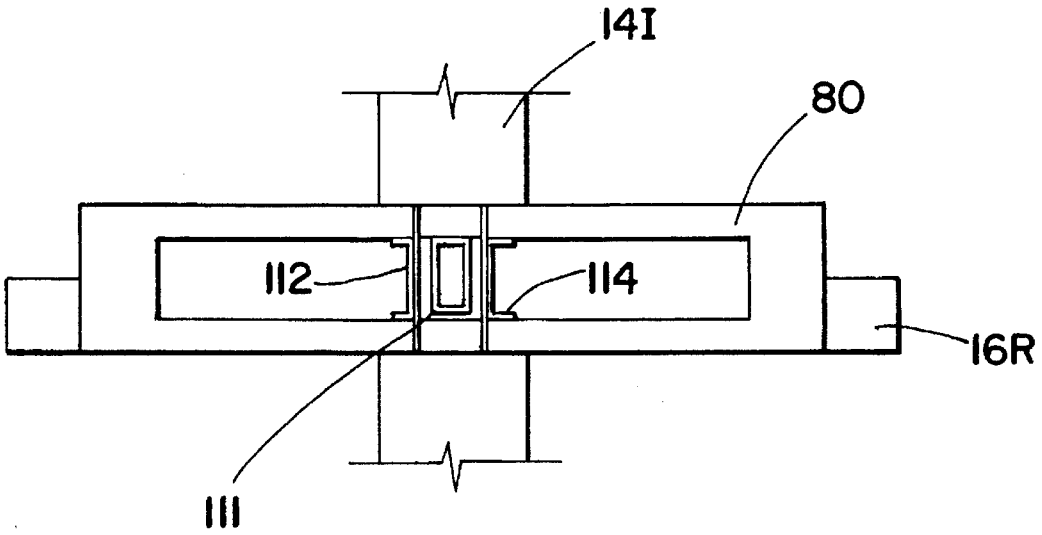
FIG. 33 is a fragmentary, elevational, sectional view of another beam showing air ducts in the beam.

In FIG. 32, there is shown a plan view of a beam 14I supporting panels 16Q and 16O having a steel tube 110 passing through the column 14I and the beams 16Q and 16O which may be used to contain wiring or as a ventilation tube or for pipes in a manner known in the art. To support the steel tube 111, two steel channels 112 and 114 are mounted on either side of the steel tube. Concrete may be used to fill in the space between the steel channels 112 and 114 and the tube 111, both in the column and the beams. This is best shown in FIG. 31, which is a sectional view of the beam 16R and the column 14I showing the steel tube 111 supported from the steel channels 112 and 114 with a portion of the beam which has less concrete to reduce weight.

Figure 34:
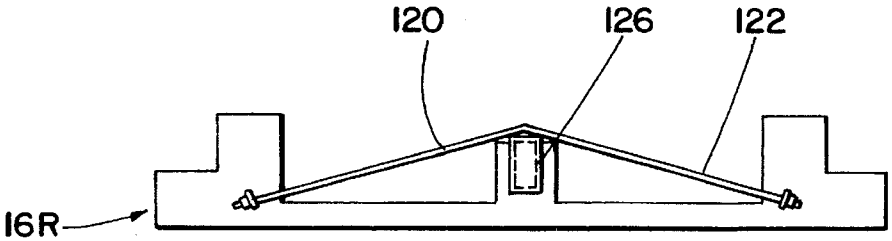
FIG. 34 is a fragmentary, elevational, sectional view of still another beam illustrating conduits for duct work.

In FIG. 34, there is shown a section of the beam 16R near the center for reduced load containing the channel or steel tube 126 and supported by two support rods 120 and 122, sometimes referred to as one inch diameter Dywidag bars, each positioned at a different side of the top of the steel tube and extending in different directions to apply tension between the center portion of the beam and the sides to provide transverse reinforcement.

From the above description, it can be understood that the components of the building, the building and techniques used in erecting the building and fabricating the components have several advantages, such as: (1) the building utilizes shallow beams thus permitting a more economical building; (2) the technique of erecting the building requires less time for use of heavy cranes for lifting the component parts in place; and (3) the component parts may be easily tailored to reduce bearing load.

Although a preferred embodiment of the invention has been described with some detail, many modifications and variations in the preferred embodiment are possible in light of the above teachings. Therefore, it is to be understood that, within the scope of the appended claims , the invention may be practiced other than as specifically described.

What is claimed is:

1. A precast elongated concrete beam comprising:

a substantially flat top surface;

a bottom surface;

first and second substantially parallel end surfaces of said beam;

first and second substantially parallel side surfaces of said beam;

said beam having a longitudinal axis;

said first end surface of said beams being substantially orthogonal to the longitudinal axis at a first end of the longitudinal axis;

said second end surface of said beam being substantially orthogonal to the longitudinal axis at a second end of the longitudinal axis;

said first parallel side surface being substantially parallel to the longitudinal axis;

said second parallel side surface being substantially parallel to the longitudinal axis;

a cross section of the precast concrete beam midway between the first and second substantially parallel end surfaces having a smaller cross sectional area containing concrete and a lower moment of inertia than cross sections nearer to either one of the first or second parallel end surfaces;

said precast elongated beam having a first opening with a vertical axis between said top and bottom surfaces sized to receive a first column near said first end and a second opening having a vertical axis between said top and bottom surface near said second end sized to receive a second column;

a first ledge extending from said first side surface and a second ledge extending from said second side surface wherein joists may be supported;

said first and second ledges being parallel to each other, level with each other and horizontal.

2. A precast concrete beam in accordance with claim 1 in which the concrete is reduced at said cross section by sloping the bottom surface of a longitudinal central section portion.

3. A precast concrete beam in accordance with claim 1 in which the concrete is reduced at a cross section by void portions enclosed in the beam.

4. A precast concrete beam in accordance with claim 1 in which a duct is enclosed in the concrete, whereby air ducting, plumbing or electrical conduits may be provided.

5. A precast concrete beam in accordance with claim 2 having a third opening through said longitudinal central section portion near said one end orthogonal to the first opening whereby a support member can be inserted through the beam and column to hold the beam in place.

6. A beam in accordance with claim 5 in which the beam at each of its ends includes at least one member fastened to the concrete and adapted to be fastened to a corresponding member in another beam.

7. A precast concrete structure comprising:

at least one concrete column;

said at least one concrete column having cast-in-place concrete sections;

said cast-in-place concrete sections having reinforcing rods passing therethrough substantially parallel to a longitudinal axis of said at least one column;

beams mounted orthogonally to said at least one column;

a wire cage mounted orthogonally to a longitudinal axis of the beams and of at least one column;

said beams being joined to said at least one column by cast-in-place concrete that is cast over the cage;

a reinforcing structure comprising metal struts orthogonal to the longitudinal axis of said beams and the longitudinal axis of said at least one column;

said beams containing more concrete near the at least one column than at a distance from the at least one column.

8. A structure in accordance with claim 7 further including steel ducts through said beams.

9. A method of erecting concrete structures including the steps of:

forming precast concrete beams having a vertical opening orthogonal to a longitudinal axis of the beams sized to receive a column;

erecting columns having horizontal supporting surfaces therein orthogonal to a longitudinal axis of the column and spaced vertically at a plurality of different elevations along each column, whereby support members are positioned to support beams lowered from above them;

lowering a plurality of beams around each of the columns; wherein beams are supported at different elevations on the columns by said support surfaces;

resting said beams on said support surfaces, wherein said columns are erected to an elevation for several stories before beams are lowered for the lowest stories; and putting cast-in-place concrete to fill openings between said beams and said columns between ends of said beams and said columns to fill the void.

* * * * *